US007442103B1

(12) United States Patent
Carr

(10) Patent No.: US 7,442,103 B1
(45) Date of Patent: Oct. 28, 2008

(54) POWER BOAT DRIVE WITH SINGLE ENGINE AND TWIN STERN DRIVES

(75) Inventor: Richard D. Carr, Destin, FL (US)

(73) Assignee: Geared Up Systems, Inc., Destin, FL (US)

( * ) Notice: Subject to any disclaimer, the term of this patent is extended or adjusted under 35 U.S.C. 154(b) by 0 days.

(21) Appl. No.: 11/626,050

(22) Filed: Jan. 23, 2007

Related U.S. Application Data

(63) Continuation-in-part of application No. 11/059,284, filed on Feb. 16, 2005.

(60) Provisional application No. 60/622,386, filed on Oct. 27, 2004.

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS

| | | | | |
|---|---|---|---|---|
| 809,064 | A | | 1/1906 | Johnson |
| 1,359,150 | A | | 11/1920 | Boehm |
| 1,883,661 | A | | 10/1932 | Fernstrum |
| 1,999,912 | A | | 4/1935 | McPartland |
| 2,386,362 | A | | 10/1945 | Soldner |
| 2,936,730 | A | | 5/1960 | Patty, Jr. |
| 3,112,728 | A | | 12/1963 | Krause |
| 3,113,549 | A | | 12/1963 | Frank et al. |
| 3,128,742 | A | | 4/1964 | Cameron |
| 3,207,118 | A | | 9/1965 | Baldwin |
| 3,289,628 | A | | 12/1966 | Sable |
| 3,376,842 | A | | 4/1968 | Wynne |
| 3,422,789 | A | | 1/1969 | Wynne et al. |
| 3,487,805 | A | | 1/1970 | Satterthwaite et al. |
| 3,515,087 | A | | 6/1970 | Stuart |
| 3,611,973 | A | | 10/1971 | Stuart |
| 3,628,485 | A | | 12/1971 | Gill et al. |
| 3,922,997 | A | | 12/1975 | Jameson |
| 4,383,828 | A | | 5/1983 | Wynne |
| 4,385,829 | A | | 5/1983 | Nakahata et al. |
| 4,428,734 | A | | 1/1984 | Ludlow |
| 4,790,782 | A | * | 12/1988 | McCormick ..... 440/61 R |
| 5,334,061 | A | * | 8/1994 | Behm et al. ..... 440/75 |
| 5,711,742 | A | | 1/1998 | Leinonen et al. |
| 6,066,012 | A | | 5/2000 | Nagle |
| 6,132,269 | A | | 10/2000 | Belt |
| 6,142,841 | A | | 11/2000 | Alexander, Jr. et al. |
| 6,234,853 | B1 | | 5/2001 | Lanyi et al. |
| 6,361,387 | B1 | * | 3/2002 | Clarkson ..... 440/83 |
| 6,814,637 | B1 | * | 11/2004 | Quaeck ..... 440/112 |
| 6,969,289 | B2 | * | 11/2005 | Hultsch et al. ..... 440/111 |

* cited by examiner

*Primary Examiner*—Jesús D Sotelo
(74) *Attorney, Agent, or Firm*—Polster, Lieder, Woodruff & Lucchesi, L.C.

(57) ABSTRACT

This boat drive system includes a primary and first and second outboard gearboxes. A drive shaft is connected between the engine and the primary gearbox and parallel shafts are connected between each outboard gearbox and a pair of first and second stern drive units mounted to the transom. The drive system also includes a cooling system provided by cooling pads operatively connected to each gearbox.

9 Claims, 10 Drawing Sheets

POWER BOAT DRIVE WITH SINGLE ENGINE AND TWIN STERN DRIVES

CROSS REFERENCE TO RELATED APPLICATIONS

This is a continuation in part of U.S. Non-Provisional application Ser. No. 11/059,284, filed Feb. 16, 2005 which claims priority to U.S. Provisional Application No. 60/622,386, filed Oct. 27, 2004 and both of which are incorporated herein by reference.

BACKGROUND OF THE INVENTION

This invention relates generally to a power boat drive system and particularly to a drive system having a single engine and twin screw stern drive units.

The invention is adaptable for use with a single engine boat having a transverse drive shaft connected to twin propeller shafts. Power boats having a single engine, and twin propeller shafts are not in themselves new and are disclosed in U.S. Pat. Nos. 3,112,728 (Krause), 3,113,549 (Frank et. al), 3,128,742 (Cameron), 4,428,734 (Ludlow) and 6,066,012 (Nagle) which are incorporated herein by reference. Such boats have not been particularly successfully owing partly to the inadequate cooling of the drive gears and complicated mounts for the drive system.

This single engine, twin screw stern drives, solves these and other problems in a manner not disclosed by the known prior art.

SUMMARY OF THE INVENTION

This invention provides a drive system for a power boat powered by a single engine having a primary gearbox and opposed, outboard gearboxes, all gearboxes, being cooled by the cooling pads connected, as by bolts, to the gearboxes. The single engine through three gearboxes and a pair of stern drives provides the motive power for the vessel.

This drive system is for a power boat which includes an engine having a pair of drive shafts connected to a pair of stern drives mounted to the transom. The drive system includes a primary gearbox and oppositely located outboard gearboxes. The primary gearbox includes a housing and a gear arrangement connected to the engine shaft and the outboard gearboxes are operatively connected to the primary gearbox, each gearbox including, a housing and a gear arrangement connected to associated twin drive shafts through the transom and to a stern drive transmission. A cooling system is provided including cooling pads for each gearbox.

DESCRIPTION OF THE PREFERRED EMBODIMENTS

Figure 1:
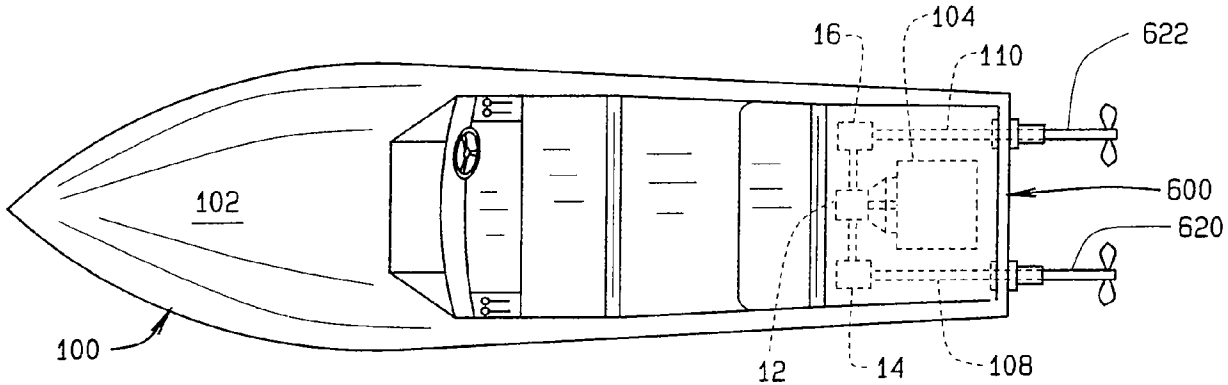
FIG. 1 is a plan view of a power boat with the single engine, twin screw system, having the engine mounted in an aft position.
Figure 2:
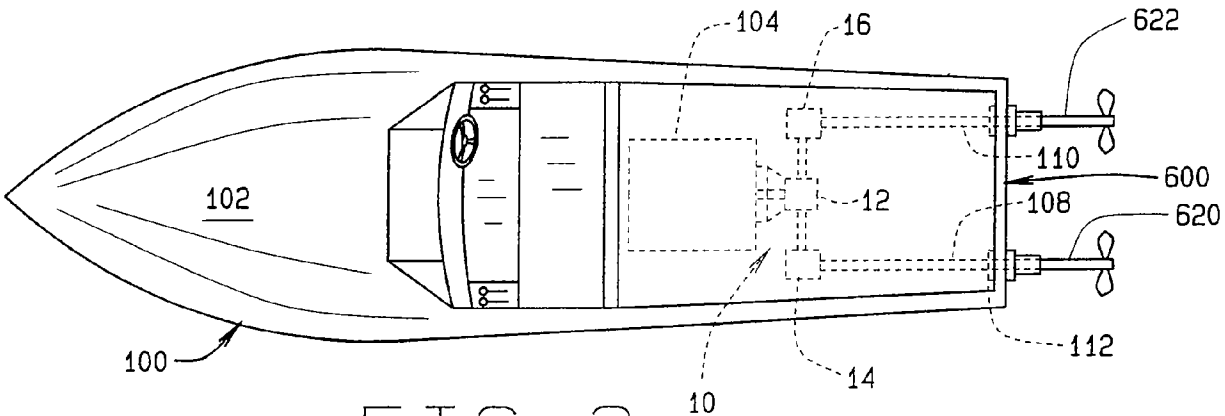
FIG. 2 is a plan view of the power boat with the single engine mounted in a forward position.

Referring now by reference numerals to the drawings and first to FIGS. 1 and 2 it will be understood that the drive system generally indicated by numeral 10 is used for a boat such as the twin screw power boat indicated by numeral 100.

In the embodiment shown in FIGS. 1 and 2 the power boat 100 includes an engine 104 mounted within the hull 102, a pair of generally parallel, laterally spaced shafts 108 and 110 each connected to a stern drive transmissions 620 and 622 mounted to the transom 600. The difference between FIGS. 1 and 2 is that in FIG. 1 the engine 104 is mounted in an aft position and in FIG. 2 the engine is mounted in a forward amidship position.

Figure 3:
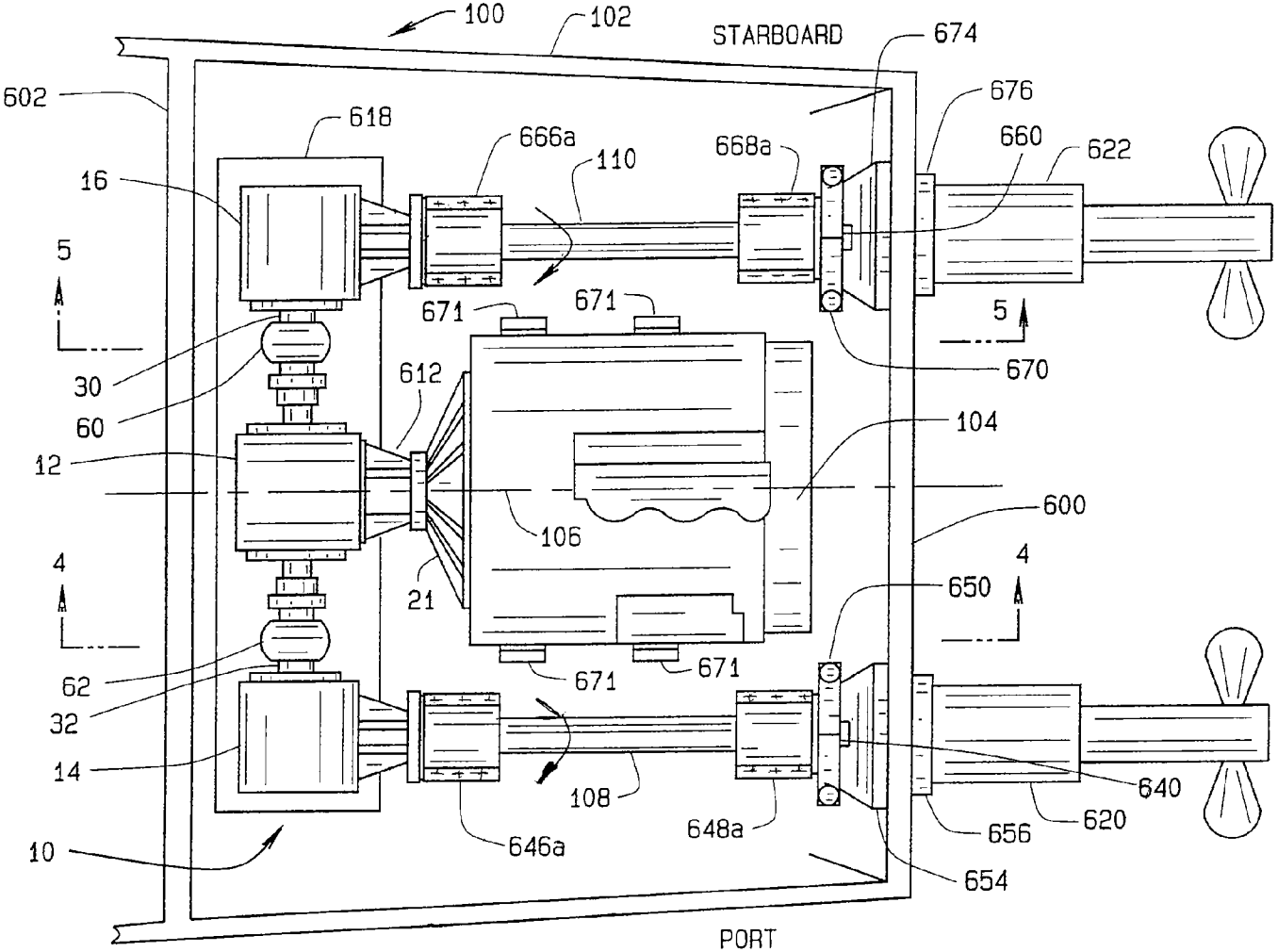
FIG. 3 is an enlarged fragmented plan view of FIG. 1.
Figure 4:
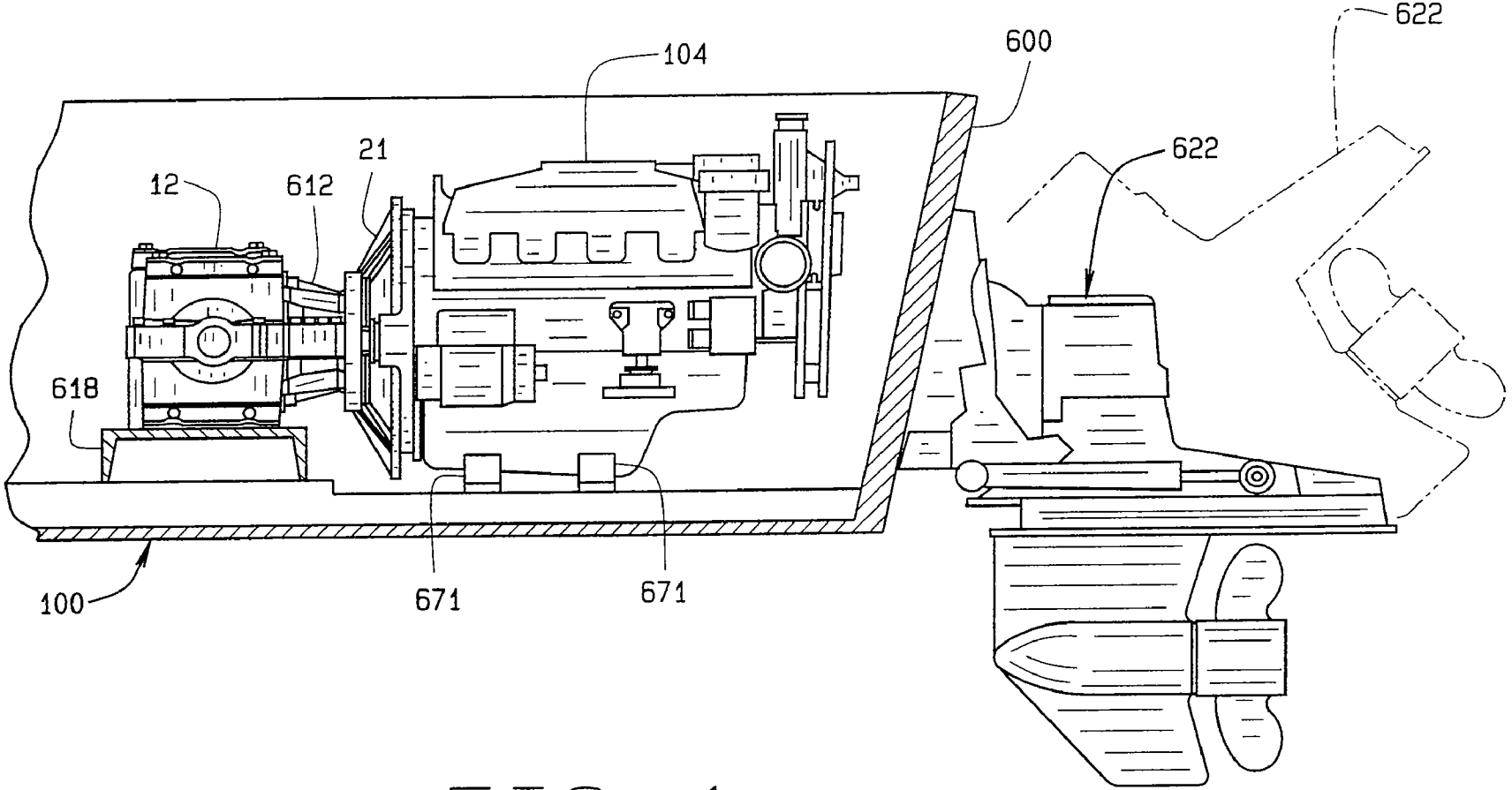
FIG. 4 is a sectional view taken on line 4-4 of FIG. 3.
Figure 5:
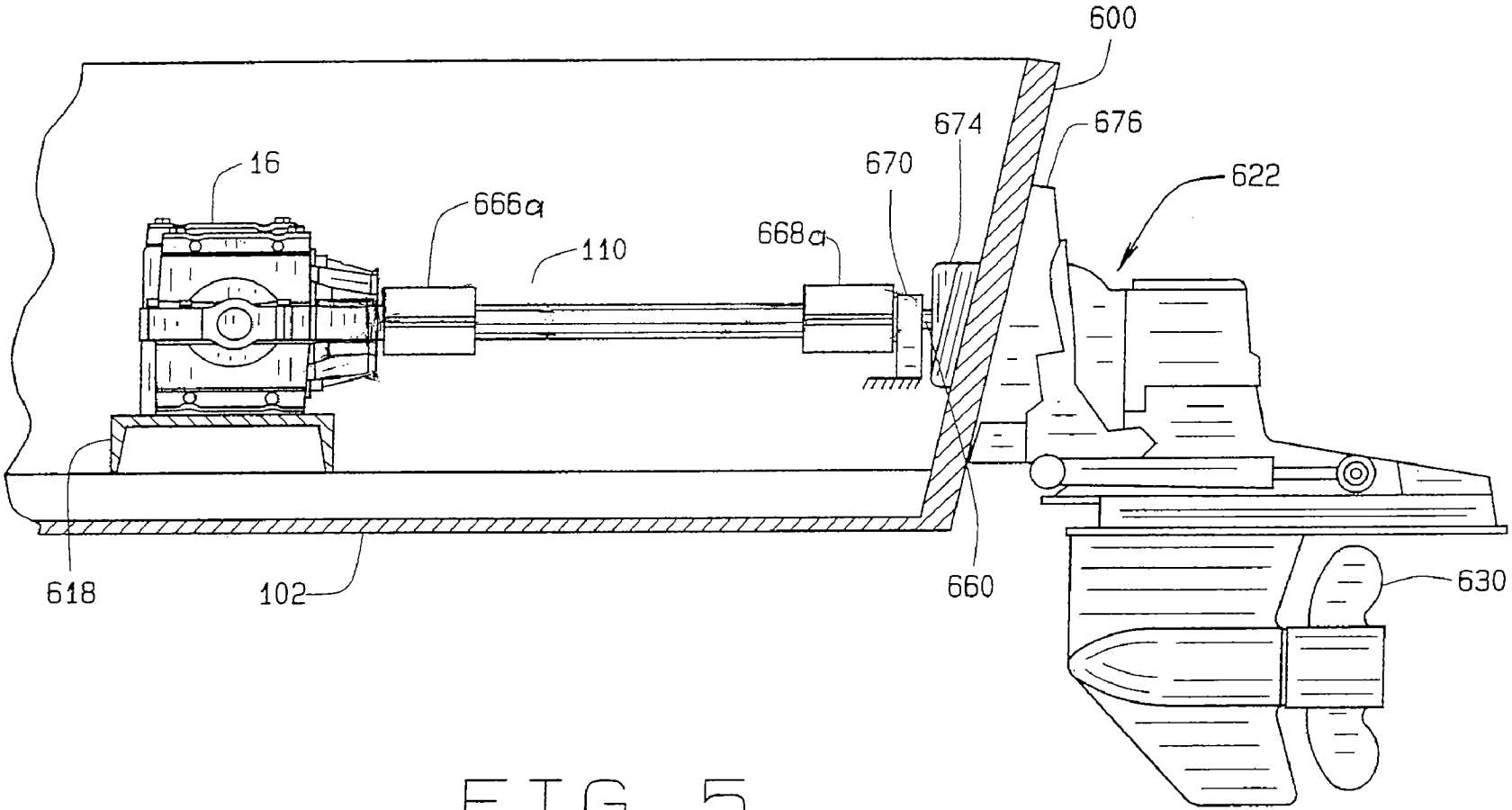
FIG. 5 is a sectional view taken on line 5-5 showing the stern drive of FIG. 3.
Figure 7:
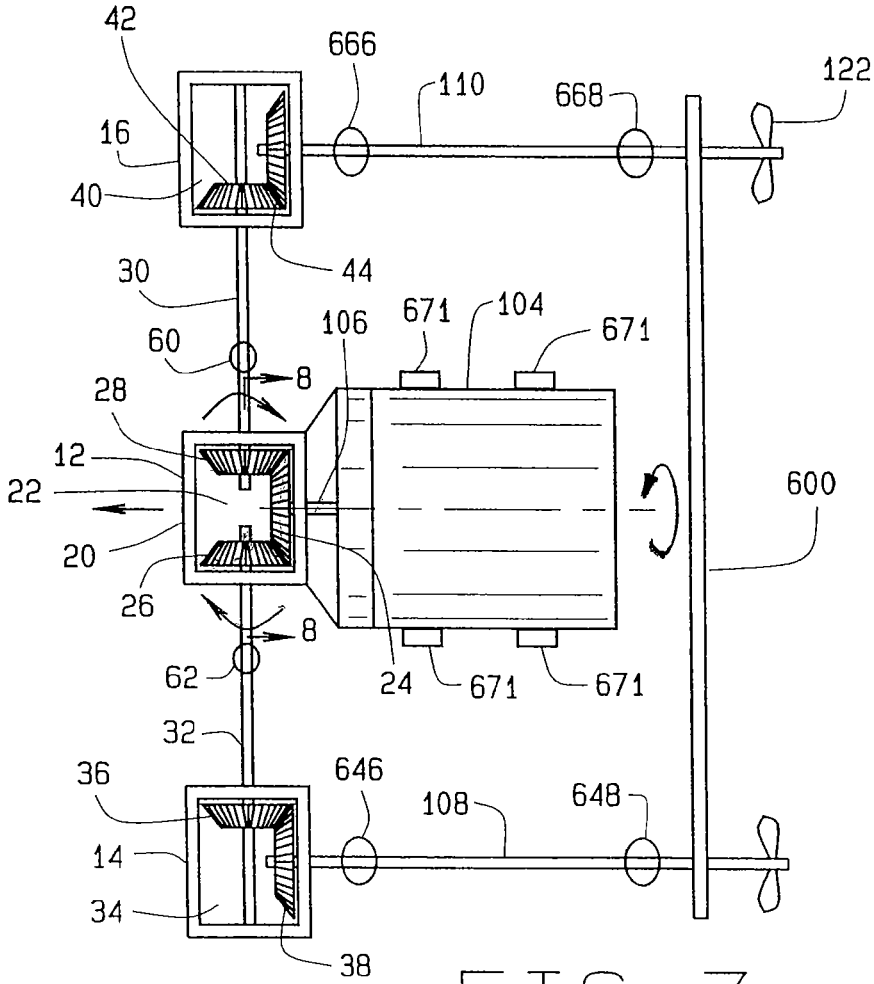
FIG. 7 is a simplified cross sectional plan view of the gear arrangement with the engine in the aft position.
Figure 8:
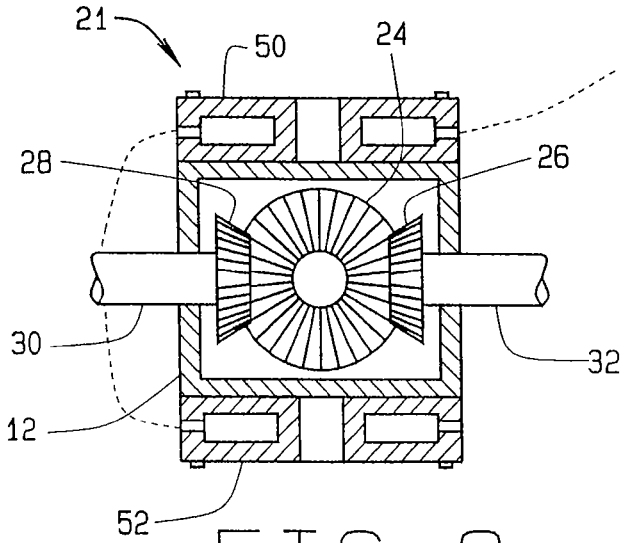
FIG. 8 is a cross-sectional view of the primary gearbox taken on line 8-8 of FIG. 7.
Figure 10:
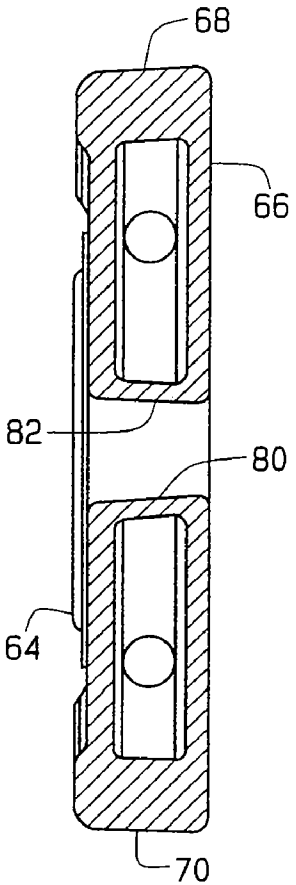
FIG. 10 is a cross-sectional view taken on line 10-10 of FIG. 9.
Figure 9:
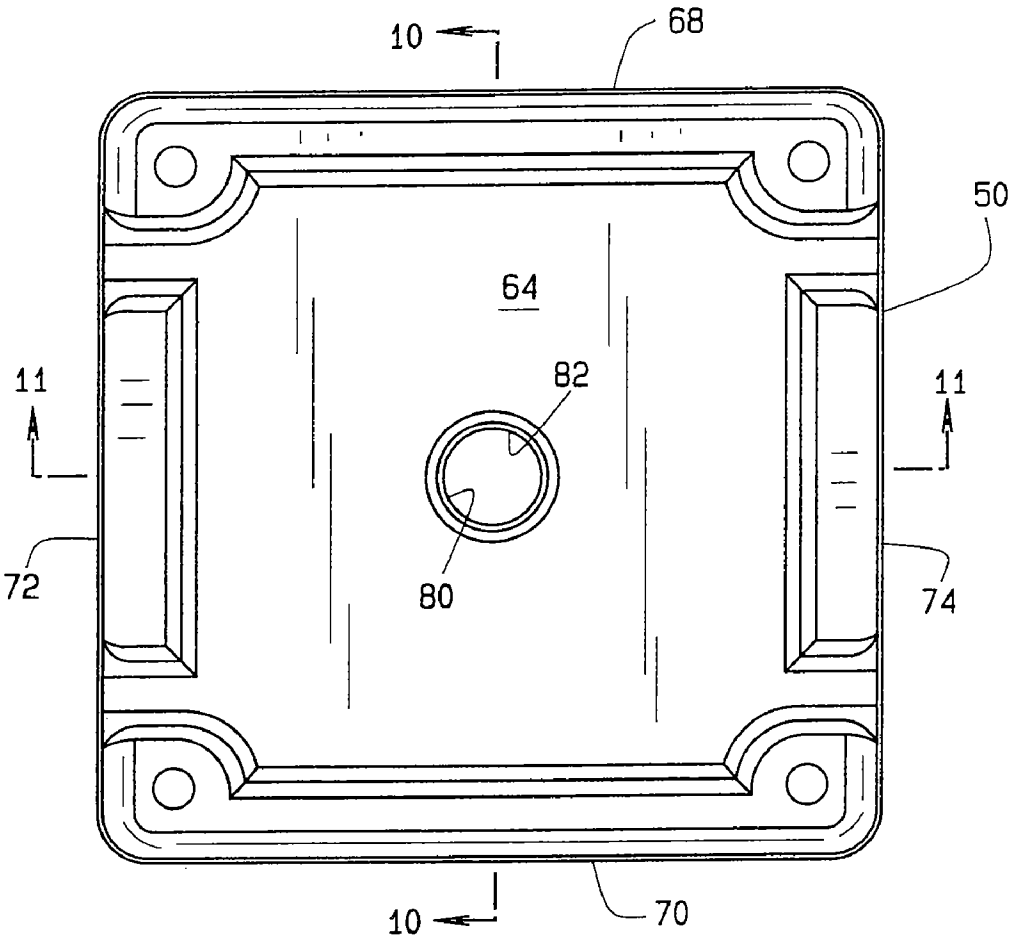
FIG. 9 is a plan view of the main gearbox cooling pad.
Figure 11:
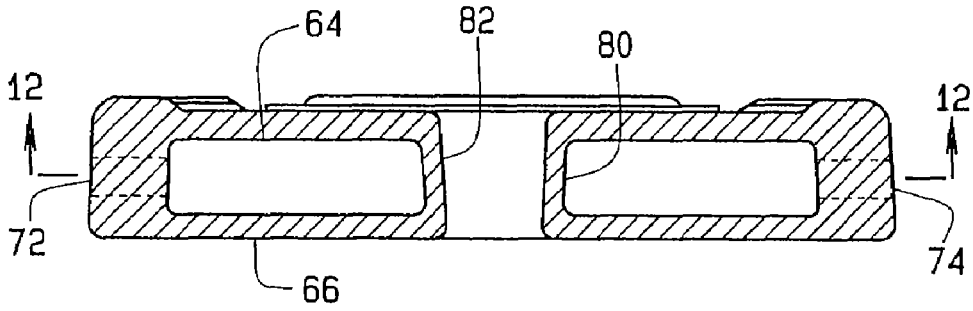
FIG. 11 is a cross-sectional view taken on line 11-11 of FIG. 10.

As shown in enlarged FIGS. 3 and 7 the arrangement of the engine 104 is in the aft position and the drive system includes a primary gearbox 12 and opposed outboard gearboxes 14 and 16, one on each side constituting first and second gearboxes, respectively. The primary gearbox 12 as shown somewhat schematically in FIG. 7 includes a housing 20 having a U-configuration gear arrangement 22 therewithin including a bevel gear 24 attached to the engine drive shaft/coupler 106 and bevel gears 26 and 28 attached to associated split shafts 30 and 32, respectively. The split shafts 30 and 32 are provided rather than having a universal, c/v joint or other coupler 60 and 62 to allow for misalignment between the gearboxes and keep the distances between the outboard gearboxes as narrow as possible. The three gearboxes 12, 14 and 16 are seated on a rigid support such as a channel 618 disposed transversely of the hull 102, as shown in FIG. 5. This arrangement holds the assembly completely rigid.

Figure 6:
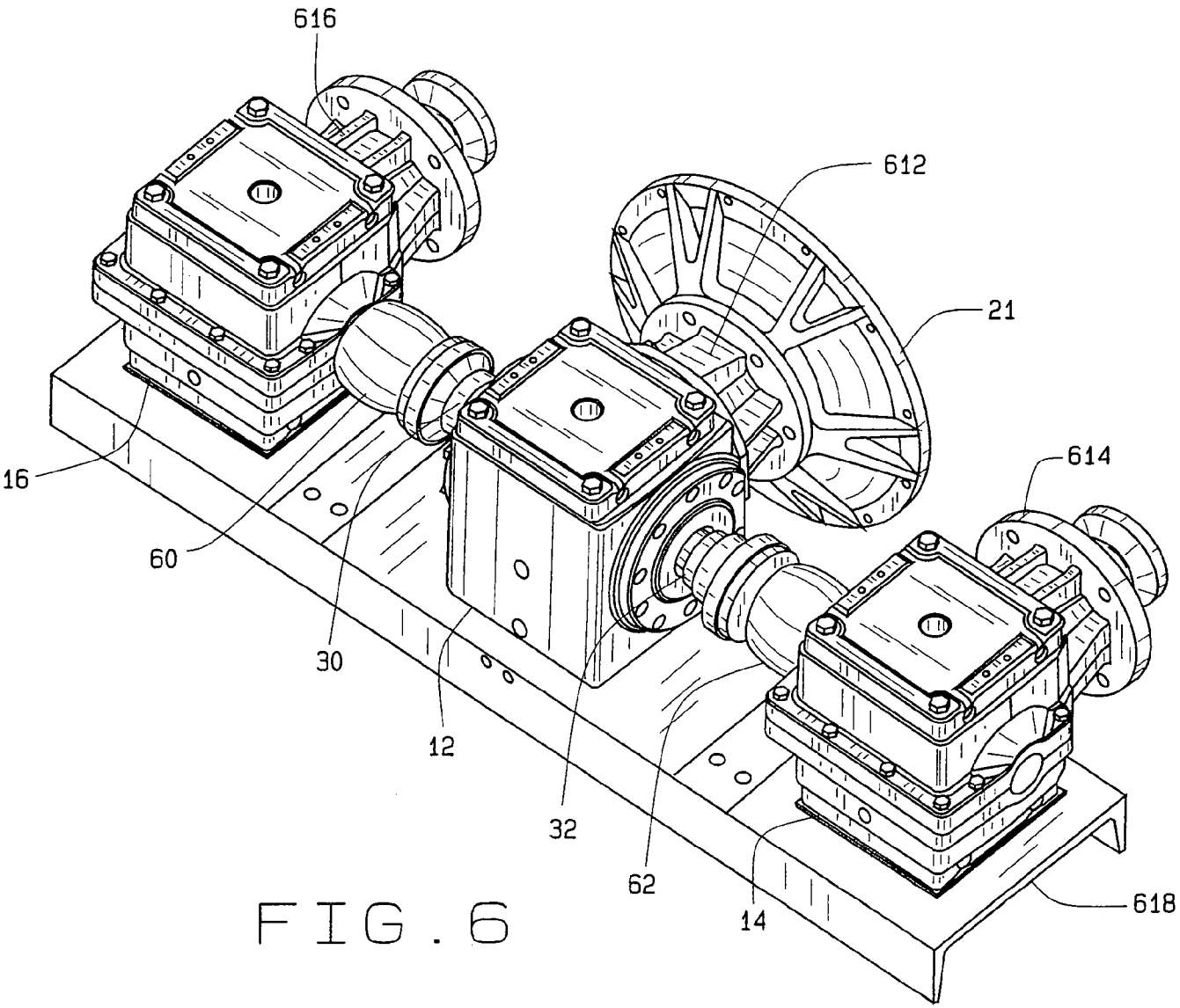
FIG. 6 is a perspective view showing the primary and secondary gearboxes, the flexible joints and the rigid support.

The three gearbox unit 12, 14 and 16 is mounted to the engine 104 using the engine adaptor 21 as shown in FIG. 6. The entire unit is cantilevered from the engine, which is mounted on four engine mounts 671, so that the unit is allowed to move with the engine within the limits of the engine mounts. If the engine torques the drive unit will move with it. The stern drive units 620 and 622 are associated with drive shafts 108 and 110 having universal joints 646 and 666 and 648 and 668, respectively, at each end mounted between the outboard gearboxes 14 and 16 and the stern drive units 620 and 622 to allow movement of the drive system 10 and provide for misalignment. The shafts 108 and 110 rotate in the same direction. The stern drives are commercially available.

The drive system 10, as described above in simplified terms, has considerable versatility. It permits, for example, the engine 104 to be disposed forward or aft of the transverse split shaft 30, 32, constituting first and second shafts respectively, which are disposed adjacent the inboard bulkhead 602 as shown in FIG. 3. The versatility of the drive system is considerably enhanced by frusto conical adaptor plate 21, which is fixedly attached to the primary gearbox 12 at its small end and fixedly attached to the engine 104 at its large end, as by bolting.

Figure 5A:
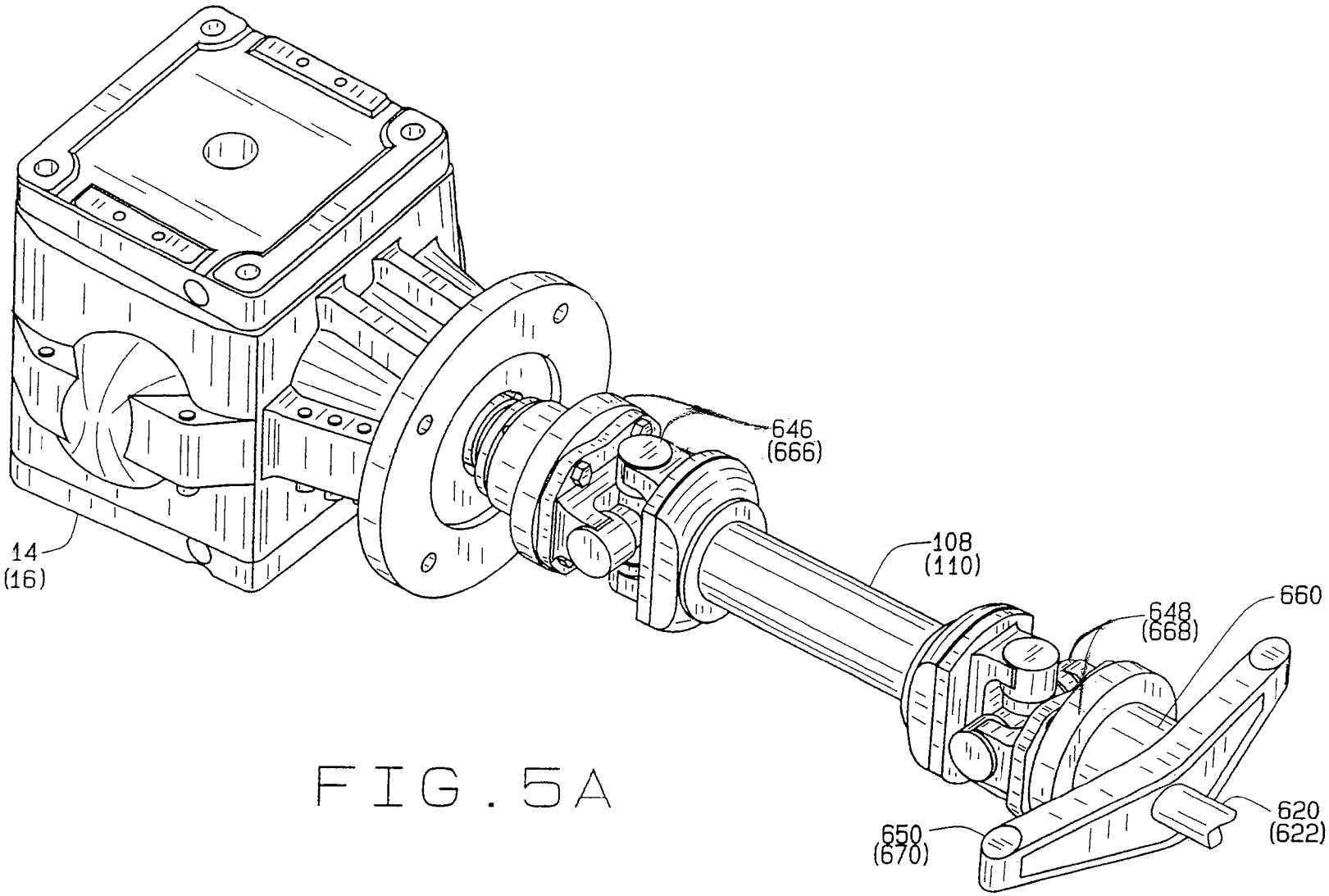
FIG. 5A is a perspective view showing the stern drive connection.

Referring more specifically to FIGS. 3-5A, the shaft 108, constituting a third shaft, includes on each end a splined receiver on universal connectors 646 and 648, hidden by safety covers 646*a* and 648*a* in FIG. 3 but shown in FIG. 5A. A bearing carrier assembly 650 is provided between the stern drive shaft 640 and the port side drive shaft 108. The stern drive 620 is connected through the transom in bearing relation by inner bracket 654 and outer bracket 656 and bearing carrier assembly 650.

With respect to the starboard drive, the arrangement is virtually identical to that described above for the port side drive except for the numbering of the parts. For example, shaft 110 which constitutes a fourth shaft, includes a splined receiver on universal connectors 666 and 668, hidden by covers 666*a* and 668*a* in FIG. 3 (as shown in parenthesis in FIG. 5A). A bearing carrier assembly 670 is shown in FIG. 5A is provided between stern drive shaft 660 and drive shaft 110. The stern drive shaft 622 is connected to the transom 600 by inner bracket 674 and outer bracket 676. A flexible bearing 678 is connected between shaft 110 and stern drive shaft 660.

Importantly, the drive system 10 described herein is preferably manufactured with a replaceable water cooling system. In the embodiment shown the cooling liquid is raw water which is tapped from the engine 104 cooling source and never comes into direct contact with the gear arrangements. This unique and efficient cooling water system is described in patent application Ser. No. 11/059,284, but for convenience will now be described with reference to FIG. 6A.

Figure 6A:
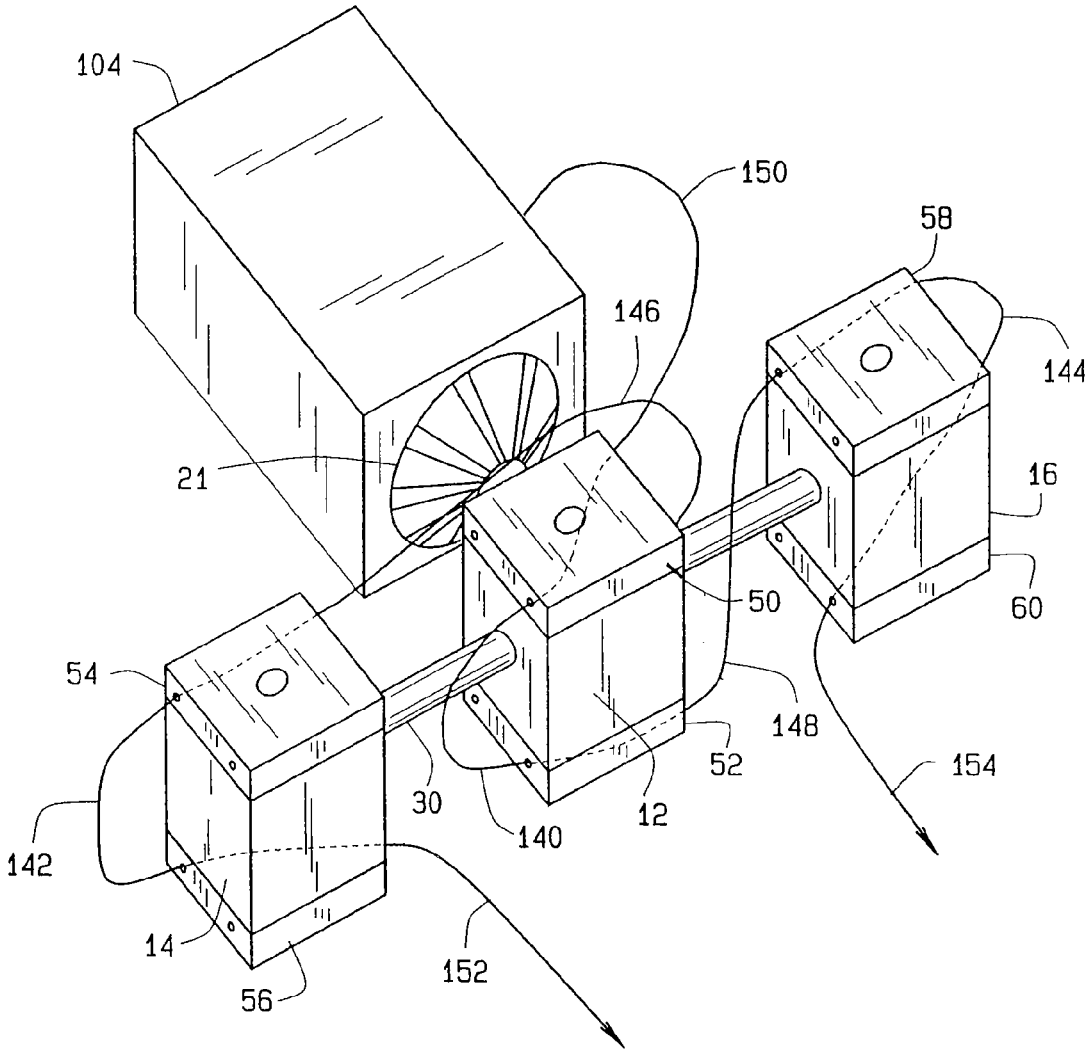
FIG. 6A is a simplified diagram showing the cooling system.

As shown in FIG. 6A, each of the three gearboxes, the primary gearbox 12 and the outboard gearboxes 14 and 16 includes opposed pairs of upper and lower cooling pads, 50 and 52 for the primary gearbox 12; 54 and 56 for the port gearbox 14 and 58 and 60 for the starboard gearbox 16. Since the gearboxes 12, 14, and 16 are cooled in substantially the same manner it is sufficient to describe the primary gearbox 12 and cooling pads 50 and 52 only in detail.

The cooling pad 50, best shown in FIGS. 9-12, is typical in that it includes an upper wall 64, a lower wall 66, and opposed sidewalls 68, 70, and 72 74. In the embodiment shown the upper and lower walls 64 and 66 are connected by a generally cylindrical tapered wall 80 defining an access opening 82 for the gear box 12. This arrangement provides a hollow chamber around the wall 80. The opposed sidewalls 72 and 74 each include two passages a and b, and c and d respectively which provide for circulation of the cooling liquid from the engine 104 to each of the three upper and three lower cooling pads 50, 52; 54, 56 and 58, 60 as best shown in FIGS. 6 and 7. It will be understood that fastener bolt receiving openings are provided at each corner of each cooling pad to provide attachment to its associated gearbox by bolts 62 received into tapped holes in the gearbox. A layer of heat sink grease, a silicone compound, may be provided between each cooling pad and its associated gear box to facilitate heat transfer.

Figure 12:
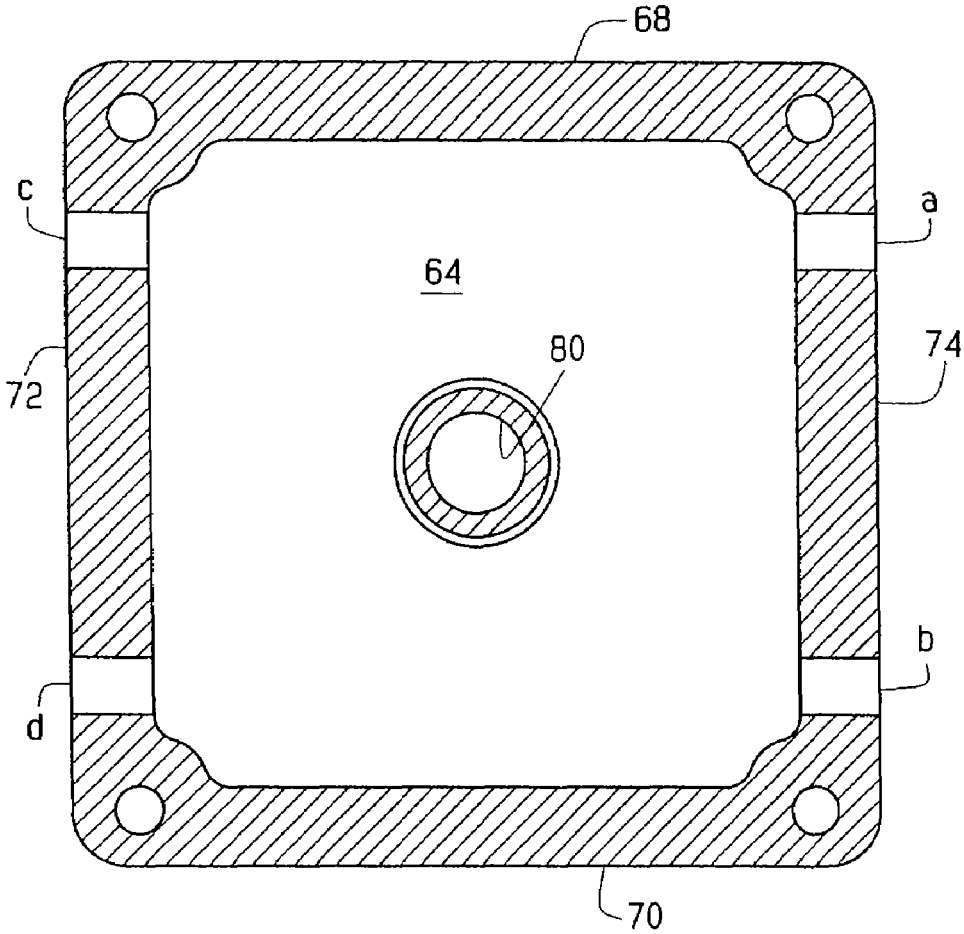
FIG. 12 is a cross-sectional view taken on line 12-12 of FIG. 11.

The cooling water is distributed to the upper and cooling pads 50, 52; 54, 56 and 56, 58 by means of inlet/outlet openings a, b, c and d and flexible conduits as shown in FIG. 6A and FIG. 12. To this end the upper and lower cooling pads are connected by loops. For example, upper and lower pads 50 and 52 are connected by hose 140 extending between openings 50*d* and 52*d*. Pads 54 and 56 are connected by conduit 142 extending between openings 54*c* and 56*c*. Pads 58 and 60 are connected by conduit 144 between opening 58*a* and 60*a*.

In order to complete the cooling distribution circuitry a flexible conduit 146 is connected between lower pad 52 and upper pad 54 by conduit 146 extending between openings 52*a* and 54*a* and conduit is connected between lower pad 52 and upper pad 58 extending between openings 52*b* and 56*c*. Cooling water is supplied from the engine 104 to upper cooling pad 50 by a flexible conduit 150 extending between an outlet from engine 104 and opening 50*a*. Finally, water is discharged from lower pad 56 by conduit 152 connected to opening 56*b* and directed to an overboard location, and by conduit 154 connected to opening 58*d* and also directed to an overboard location.

It will be understood that while the stern drive units are not shown in detail they are similar to those commonly used with double engine drive units and are raised by a hydraulic system to the position shown in broken outline when not in use.

Although the invention has been described by making detailed reference to a preferred embodiment, such detail is to be understood in an instructive, rather than in any restrictive sense many variations being possible within the scope of the claims hereunto appended.

The invention claimed is:

1. A drive system for a boat having a hull with a longitudinal axis and a single engine mounted in the hull, the drive system comprising:

a primary gearbox and opposed first and second outboard gearboxes;

a drive shaft connected between the engine and the primary gearbox;

a first shaft connected between the primary gearbox and the first outboard gearbox and a second shaft connected between the primary gearbox and the second outboard gearbox;

the hull including a transom;

first and second stern drive units mounted to the transom;

a third drive shaft connected between the first outboard gearbox and the first stern drive unit through the transom; and a fourth drive shaft connected between the second outboard gearbox and the second stern drive unit through the transom and the third and fourth drive shafts being operatively connected to the first and second stern drive units;

at least one gearbox including an associated housing and a cooling pad connected to said housing and supplied with cooling liquid.

2. A drive system as defined in claim 1 wherein the engine is disposed forwardly of the primary gearbox.

3. A drive system as defined in claim 1 wherein the engine is disposed aft of the primary gearbox.

4. A drive system as defined in claim 1 wherein the first shaft and the second shaft include flexible couplings between the primary gearbox and each outboard gearbox.

5. A drive system as defined in claim 1 wherein the primary gearbox housing and the outboard gearboxes housings are provided with a common rigid structural member transverse to the hull longitudinal axis and seating each gearbox.

6. A drive system as defined in claim 5 wherein the engine is mounted to the hull by flexible mounts.

7. A drive system as defined in claim 1 wherein the third and fourth shafts include at least two universal couplings between the first and second outboard gearbox and the first and second stern drives respectfully.

8. A drive system for a boat having a hull with a longitudinal axis and a single engine mounted in the hull, the drive system comprising:

a primary gearbox and opposed first and second outboard gearboxes;

a drive shaft connected between the engine and the primary gearbox;

a first shaft connected between the primary gearbox and the first outboard gearbox and a second shaft connected between the primary gearbox and the second outboard gearbox;

the hull including a transom;

first and second stern drive units mounted to the transom;

a third drive shaft connected between the first outboard gearbox and the first stern drive unit through the transom;

a fourth drive shaft connected between the second outboard gearbox and the second stern drive unit through the transom and the third and fourth drive shafts being operatively connected to the first and second stern drive units; and each gearbox housing including upper and lower walls and opposed cooling pads operatively connected to the upper and lower walls of associated housings.

9. A drive system for a boat having a hull with a longitudinal axis and a single engine mounted in the hull, the drive system comprising:

a primary gearbox and opposed first and second outboard gearboxes;

a drive shaft connected between the engine and the primary gearbox;

a first shaft connected between the primary gearbox and the first outboard gearbox and a second shaft connected between the primary gearbox and the second outboard gearbox;

the hull including a transom;

first and second stern drive units mounted to the transom;

a third drive shaft connected between the first outboard gearbox and the first stern drive unit through the transom; and a fourth drive shaft connected between the second outboard gearbox and the second stern drive unit through the transom and the third and fourth drive shafts being operatively connected to the first and second stern drive units;

said first and second stern drive units being tiltably connected to said transom; and at least each gearbox includes upper and lower walls and opposed cooling pads operatively connected to the upper and lower walls of associated housings.

* * * * *